United States Patent [19]

Battenberg

[11] Patent Number: 4,741,189

[45] Date of Patent: May 3, 1988

[54] KEY GUARD

[76] Inventor: Tibor Battenberg, 7 E. Ridge Dr., Merrimack, N.H. 03054

[21] Appl. No.: 914,019

[22] Filed: Oct. 1, 1986

[51] Int. Cl.[4] ..... A47G 29/10

[52] U.S. Cl. ..... 70/456 R; 70/459; 70/DIG. 55

[58] Field of Search ..... 70/459, 456 R, DIG. 54, 70/DIG. 55; 150/40; 24/3 K; D3/61, 65

[56] References Cited

U.S. PATENT DOCUMENTS

| | | | |
|---|---|---|---|
| 276,826 | 5/1883 | Jopsa | 70/459 |
| 1,626,987 | 5/1927 | Venegas | 90/459 |
| 2,615,324 | 10/1952 | Meeker | 70/459 |
| 2,855,775 | 10/1958 | Marien | 70/459 |
| 3,362,201 | 1/1968 | Lachin | 70/459 |
| 3,635,058 | 1/1972 | Polk | 70/459 |
| 3,776,009 | 12/1973 | MacGhashan | 70/459 |
| 4,079,607 | 3/1978 | Sproyt | 70/456 R |
| 4,324,121 | 4/1982 | Richter | 70/459 |

FOREIGN PATENT DOCUMENTS

| | | | |
|---|---|---|---|
| 854204 | 1/1940 | France | 70/459 |

*Primary Examiner*—Robert L. Wolfe

*Attorney, Agent, or Firm*—Pearson & Pearson

[57] ABSTRACT

A key guard comprises a key ring having an absent segment. A channel in the guard captures and restrains the ring to circular motion along its arc. A follower carries an interposer which intersects the channel under spring action of a spring means symmetrically positioned with respect to a central axis. The spring means may be a pair of compression springs, or a pair of spring arms acting on the follower. The ring and the key guard may be flat.

6 Claims, 1 Drawing Sheet

KEY GUARD

FIELD OF THE INVENTION

The invention relates to key ring guards, and particularly to key guards which have a ring on which keys may be threaded for safekeeping, or unthreaded.

BACKGROUND OF THE INVENTION

Key ring guards are known. For example, U.S. Pat. No. 1,626,987, May 3, 1927 to J. P. Venegas for "Key Lock" describes a key ring in a guard or lock which is released or locked by a handle advanced or retracted. When retracted the ring may be turned or rotated to an open segment on which keys may be threaded or unthreaded. When the segment is returned to a lock position, the guard is advanced to a lock position preventing rotation of the ring. In U.S. Pat. No. 2,615,324 to Meeker, Oct. 28, 1952 for "Key Ring", the patentee suggests a key ring having a guard mechanism which is rotated to uncover an open segment of a ring on which keys may be returned to cover the open segment and prevent the threading or unthreading of keys on the segment.

U.S. Pat. No. 2,855,775 to Marien, Oct. 14, 1958 for "Key Holder" suggests a key ring having an open segment, and a spring actuated interposer which enters the open segment when the latter is in opposed position to the interposer. When retracted, the interposer admits a rotation of the ring to expose the open segment for threading or unthreading keys on the ring; when interposed the segment is not exposed and threading or unthreading keys is not possible. U.S. Pat. No. 3,362,201 to Lachin, Jan. 9, 1968 for "Key Holder" shows a spring loaded interposer which enters into a ring segment to prevent threading or unthreading keys on the ring; when the interposer is withdrawn, the ring may be rotated and keys threaded or unthreaded upon it. U.S. Pat. No. 3,635,058 to Polk, Jan. 18, 1972 for "Keyring Construction" proposes a spring loaded assembly of two parts, one of which is a segmented key ring. The spring prevents separation of the parts and holds the segmented part of the segmented ring in a position to be closed by the other part, also in the form of a ring. On separation of the parts against the spring loading, the segmented ring may be rotated for engagement or disengagement of keys; when returned to position in which the segment is closed, the keys are guarded in place. U.S. Pat. No. 4,079,607 to Spruyt, Mar. 21, 1978 for "Key Ring Structure" describes a key ring having an open section or segment, and a spring loaded cover urged into covered position to cover the open segment and thus prevent threading or unthreading of keys; when the spring loaded cover is withdrawn against the spring, the open segment is exposed for threading or unthreading of keys.

SUMMARY OF THE INVENTION

According to the invention a housing contains a circularly arcuate channel extending for a part of a circle and a longitudinal channel having a longitudinal axis. The longitudinal channel captures a follower to restrain the follower to slide longitudinally therein, and the follower carries an interposer which intersects the arcuate channel. A spring means is disposed in the housing symmetrically about the longitudinal axis and symmetrically with respect to the axis and applied to the follower to urge the follower longitudinally to carry the interposer toward the intersection. The arcuate channel captures a ring which is absent a sector arcuately less than the arcuate extent of the arcuate channel. A finger control is attached to and controls the follower from outside the housing.

The follower is urged by the spring means to carry the interposer into locking position interposed in the arcuate channel, thus to lock the ring against rotation in the arcuate channel. One may retract the interposer by the finger control against the spring means to unlock the ring for circular rotation in the arcuate channel to expose the absent sector outside the housing for threading or unthreading of keys; when the ring is rotated to return the absent sector to the intersection, the spring means symmetrically urges the follower for retention of the interposer in locking position to lock the ring against further rotation and thereby to retain and guard the keys on the ring.

DETAILED DESCRIPTION

Figures 1, 2, 3, 4, 5, 6, 7, 8, 9, 10:
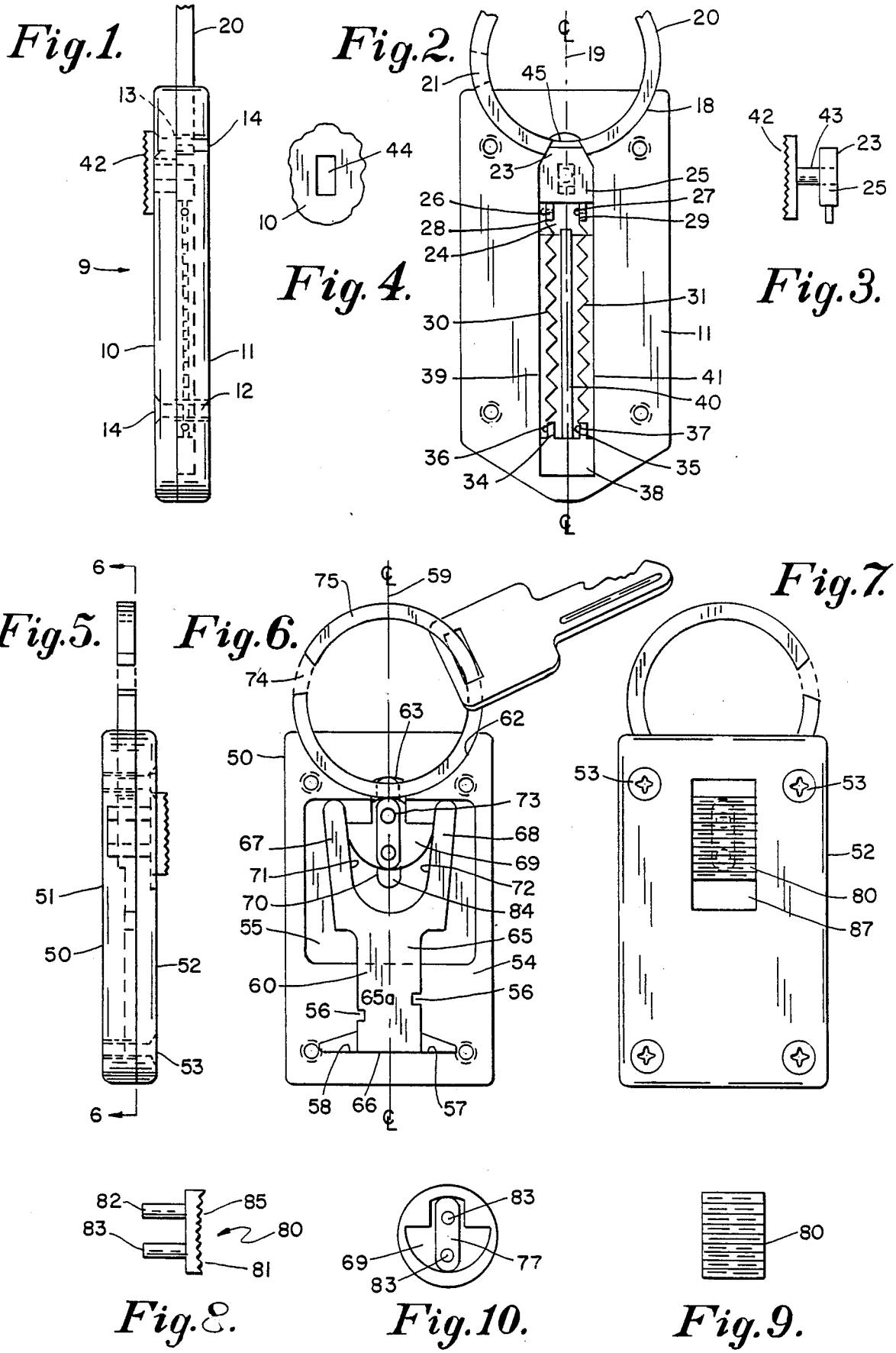
FIG. 1 is a side view of a first embodiment of the invention.
FIG. 2 is a front sectional view of the embodiment of FIG. 1 with the top removed.
FIG. 3 is a side view of a finger control of FIG. 2.
FIG. 4 is a front view of a portion of a top of a housing of FIG. 1.
FIG. 5 is a side view of a second embodiment of the invention.
FIG. 6 is a front sectional view along the lines 6—6 of FIG. 5.
FIG. 7 is a front view of a top of the embodiment of FIG. 5.
FIG. 8 is a side part view of a finger control of FIG. 5.
FIG. 9 is a front view of a portion of a finger control of FIG. 5.
FIG. 10 is a view of the follower shown in top view in FIG. 6.

Referring to FIGS. 1–4, a housing 9 comprises a top 10, and a bottom 11, both relatively flat pieces, and secured together by screws 14 countersunk in apertures 12, in the bottom 11, and screwed into four threaded apertures 13 in the top 10.

A circularly arcuate channel 18 in the bottom 11 extends for an arc of a circle of about 30°, and exits from two areas above, as viewed in FIG. 2, in a manner bilaterally symmetrically about a center line or axis 19, of symmetry which lies on a radius of the circle. The channel 18 captures a ring 20 which is completely circular except for an absent segment 21 of a few degrees.

A longitudinal channel 24 contains a follower 25 carrying an interposer 23 which the channel 24 constrains to a short longitudinal stroke or motion. The follower carries two downwardly projecting posts 26, 27, one symmetrically on each side of the axis 19, to assist in positioning the ends 28,29 respectively of a pair of springs 30,31. A pair of posts 34, 35 respectively position the other ends 36,37 of springs 30, 31 respectively at an end block 38. Longitudinal channels 39 and 41 in the bottom 11 symmetrically with respect to axis 19 contain and restrain springs 30, 31 respectively, which are under compression. If desired, channels (not shown) matching 39 and 41 may be grooved in the top 10 to assist in restraining the springs 30,31. The two longitudinal channels 39 and 41 are separated by a longitudinal boss 40.

A finger control 42 is attached to the follower 25 as by a post 43. The post 43 passes through a short longitudinal opening or slot 44 in the top 10. The slot 44 affords sufficient space to move the follower 25 and interposer 23 by the finger control 42 longitudinally for a sufficient stroke to uncover the intersection 45 of the circular channel 18 and the channel for following along the axis 19.

In the position of the key guard, or container as shown in solid lines in FIGS. 1–4, and particularly FIG. 2, the follower 25 and interposer 23 is interposed in the intersection 45 to prevent and lock against circular motion the ring 20 along its own circumference. When the finger control 42 is moved longitudinally against the compression of the springs 30,31 to withdraw the follower 25 and interposer 23 from interposition in the intersection 45, the springs 30, 31 are compressed, the ring 20 is unlocked and may be rotated until the absent segment 21 is, for example, in the exposed position indicated by dotted lines in FIG. 2. Now keys may be threaded on, or unthreaded from, the ring 20. After the keys are threaded or unthreaded as desired, the ring 20 may be rotated to return the absent segment 21 to its original position. The interposer 23 and follower 25 under action of the finger control 42, and the springs 30, 31 again enters into the intersection 45 and locks the ring 20 against further rotation so that the keys are retained and guarded on the ring 20.

Among the advantages of the bilateral symmetrical arrangement of the channels and springs about the central axis 10, is that a thin key guard may be constructed having the same guard value as a thicker construction with a single spring. Hence, this construction is advantageous in manufacturing an extremely thin and attractive key guard.

A second preferred embodiment of the invention, with like advantage, is illustrated in FIGS. 5–10. The back 50 of a housing 51 is joined to the front 52 by means such as screws 53, which may be countersunk in the front 52 and threaded into the back 50.

The back 50 has an upper face 54 which has a rectangular sunken or relief portion 55, and a lower longitudinal cut 56 near the lower end 60 of the back 50, as viewed in FIG. 6. At the lower end of relief portion 55 at 57, the cut 56 spreads laterally with the lowermost margin 58 perpendicular to the central longitudinal axis 59. The relief section is bilaterally symmetrical with respect to the central axis 59. At its upper portion the relief section communicates with a flat circularly arcuate channel 62.

In deeper relief than the relief section is a longitudinal channel 63 bilaterally symmetrical with axis 59. The longitudinal channel 63 intersects the extension on completion of the circularly arcuate channel 62. Thus, the arcuate channel 62, relief section 55, 56, 57, and 58 in its entirety, and also the deeper relief longitudinal channel 63 are bilaterally symmetrical with respect to longitudinal axis 59.

The longitudinal cut 56 contains a flat Y-shaped bar 65 the lower edge 66 of which seats against the margin 58. The upper branches, or arms, 67, 68 of the Y bar 65, and the bar itself are thus held bilaterally symmetrically with respect to the longitudinal axis 59. The arms 67, 68 may thus move under longitudinal force by spring action while the leg **65*a* of the Y bar 65 is held between the edges of the longitudinal cuts 56. The arms 67, 68 receive between them a follower 69. A lower circularly cylindrical edge 70 of follower 69 bears at about 90° apart on each inner linear edge 71, 72 respectively of the arms 67, 68. Thus, the follower 69 is, so to speak, cradled between the arms 67, 68. The upper part of follower 69 is in the form of an interposer or locking portion 73 which is of a shape to slip into and fit in the absent segment 74 of a flat ring 75. The arcuate channel 62 captures the ring 75 and allows the ring only rotational motion in its own arc. On the reverse side, as viewed in FIG. 10, the follower has a raised longitudinal boss or bar element 77, which enters in, and is guided for longitudinal motion in the longitudinal channel 63. The cylindrical edge 70 is opposite the intersection of the interposer 73, and arcuate channel 62**.

The follower 69 is controlled by a finger control 80 formed of an exposed portion 81, and a pair of concealed posts 82 and 83 which fasten the control 80 to the follower 69. The posts 82 and 83 may be fastened by light riveting, adhesive, or any other suitable expedient. The posts 82 and 83 are guided in a longitudinal slot 84 in the front 52. The face 85 of the exposed portion 81 of control 80 may be dished concavely as shown in FIG. 8 and knurled or roughened as indicated in FIGS. 8 and 9 for ease of finger control. A slight depression 87 may be provided on the front surface of the front 52 for initials, or the like.

As shown in FIG. 6, the key guard is in a position to receive keys which may be threaded on, or removed from, the ring 75 at the exposed absent segment 74. The follower 69 and interposer 73 is restrained from interposition at the intersection of the longitudinal channel 63 (or its extension) and the arcuate channel. Thus, the ring 75 is unrestrained for circular motion along its own arc.

When the ring 75 is rotated to bring the absent segment 74 to the intersection of the longitudinal stroke of interposer 73 and the arcuate channel 62, the interposer 73 may be moved by joint action of the finger control 80 and the spring action of the distended arms 67, 68 to enter the absent ring segment 74 and thus, lock the ring against circular motion along its arc. The new position of ring 75 and interposer 73, and of spring arms 67, 68 is indicated by dotted lines in FIG. 6. The spring action of the arms 67, 68 will now retain the interposer 73 in locking position.

The construction of the embodiment of FIGS. 6–10 also allow an extremely thin, comfortable, flat key ring and key guard to contain the keys in well guarded arrangement. The Y shaped bar 65 may be made of any material including a resin based material, such as lexan or hard rubber and the spring arms may exert longitudinal spring action on the follower 69 by cam action against the circular edge 70. The longitudinal urging of the follower 69 need only be sufficient to restrain accidental opening by retraction of the follower 69 and to prevent withdrawal of the interposer 73 from its intersection with the circular channel 62.

I claim:

1. A key guard comprising:

a housing comprising a top and a bottom;

means for joining the top and bottom forming between them when joined, a circularly arcutate channel extending arcuately for a part of a circle, and a longitudinal channel having a longitudinal axis;

a follower captured in and free to slide longitudinally and radially in the longitudinal channel and carrying an interposer movable radially to intersect the arcuate channel;

a finger control attached to the follower, the top having a slot through which the finger control extends outside the housing;

spring means comprising a plurality of symmetrical compression springs disposed in the housing symmetrically about the axis and applied symmetrically with respect to said axis to the follower to urge the follower longitudinally toward the intersection, the spring means having a portion remote from the follower and the remote portion having an end;

the housing having longitudinal channel means, said channel means comprising separate channels for each spring and having side walls parallel to the axis and having end wall means remote from the follower, the side walls restraining the spring means end from movement transverse to the axis and the end wall means restraining the spring means end from longitudinal motion; and a ring captured in the arcuate channel absent a sector arcuately less than the arcuate extent of the arcuate channel;

whereby the follower and interposer are urged by the spring means into locking position interposed in the absent segment in the arcuate channel at the intersection to lock the ring against rotation in the arcuate channel, whereby the follower may be retracted by the finger control against the spring means to unlock the circular rotation in the arcuate channel to expose the absent sector outside the housing for threading of keys, and whereby when the ring is rotated to return the absent sector to the intersection of the arcuate channel and the interposer, the spring means symmetrically urges the follower for retention in locking position at the intersection to lock the ring against further rotation and thereby retain the keys on the ring.

2. A key guard as claimed in claim 1:

the end wall means including an end block having posts to which the springs at the remote portion are respectively attached symmetrically about the axis, and the follower having posts symmetrical with respect to the axis by means of which the spring means are applied symmetrically to the follower.

3. A key guard comprising:

a housing comprising a top and a bottom;

means for joining the top and bottom forming between them when joined, a circularly arcuate channel extending arcuately for a part of a circle, and a longitudinal channel having a longitudinal axis;

a follower captured in and free to slide longitudinally and radially in the longitudinally channel and carrying an interposer movable radially to intersect the arcuate channel;

a finger control attached to the follower, the top having a slot through which the finger control extends outside the housing;

spring means disposed in the housing symmetrically about the axis and applied symmetrically with respect to said axis to the follower to urge the follower longitudinally toward the intersection;

a ring captured in the arcuate channel absent a sector arcuately less than the arcuate extent of the arcuate channel;

said housing comprising a pair of longitudinal channels each having a longitudinal axis parallel to and symmetrically disposed on opposite sides of the axis, said channels lying in the same plane, said spring means comprising a pair of symmetrical springs individually compressed in said pair of channels to urge said follower interposer longitudinally toward said intersection;

whereby the follower and interposer are urged by the spring means into locking position interposed in the absent segment in the arcuate channel at the intersection to lock the ring against rotation in the arcuate channel, whereby the follower may be retracted by the finger control aganist the spring means to unlock the circular rotation of the ring in the arcuate channel to expose the absent sector outside the housing for threading of keys, and whereby when the ring is rotated to return the absent sector to the intersection of the arcuate channel and the interposer, the spring means symmetrically urges the follower for retention in locking position at the intersection to lock the ring against further rotation and thereby retain the keys on the ring.

4. A key guard as claimed in claim 1 wherein said spring means comprises a Y-shaped element in the housing, the leg of the Y of the element being in a line coaxial with the longitudinal axis and being the end portion restrained in the channel means from transverse motion, and the element having Y arms comprising spring flex arms symmetrical about the axis:

the follower having opposite the intersection a pair of symmetrical camming surfaces against which the spring means arms are flexed, whereby the spring means arms urge the follower and its interposer by reaction against the camming surface to slide toward the intersection.

5. A key guard as claimed in claim 4, said camming surfaces comprising a portion of a circular cylinder presented on the side of the follower opposite the intersection and having the same center and radius of curvature symmetrically on each side of the axis, the key ring being flat.

6. A key guard as claimed in claim 1, said channel means including a pair of longitudinal channels each having a longitudinal axis parallel to and symmetrically disposed on opposite sides of the axis, said channels lying in the same plane, said spring means comprising a pair of symmetrical springs individually compressed in said pair of channels to urge said follower interposer longitudinally toward said intersection.

* * * * *